US005546707A

United States Patent [19]

Caruso

[11] Patent Number: 5,546,707

[45] Date of Patent: Aug. 20, 1996

[54] POLYETHELENE INFLATABLE TUBE CONSTRUCTION DEVICE

[76] Inventor: Vincent C. Caruso, 140 Pacific Dr., Quakertown, Pa. 18951

[21] Appl. No.: 368,860

[22] Filed: Jan. 5, 1995

[51] Int. Cl.[6] ..... E04B 1/34

[52] U.S. Cl. ..... 52/213; 52/221; 52/736.3

[58] Field of Search ..... 52/211, 2.13, 2.21, 52/720.1, 730.1, 732.1, 736.3, 737.4, 738.1, 653.2, 2.18; 285/179

[56] References Cited

U.S. PATENT DOCUMENTS

| | | | |
|---|---|---|---|
| D. 324,544 | 3/1992 | McKinney | D21/200 |
| 2,765,014 | 10/1956 | Muller | 52/2.21 |
| 2,886,262 | 5/1959 | Fletcher | 285/179 X |
| 3,277,479 | 10/1966 | Struble, Jr. | 52/2.21 X |
| 3,870,346 | 3/1975 | Kappeler et al. | 285/179 X |
| 3,928,879 | 12/1975 | Britschinn et al. | 9/400 |
| 4,068,418 | 1/1978 | Masse | 52/2.21 |
| 4,197,681 | 4/1980 | Holcombe | 52/2 |
| 4,271,642 | 6/1981 | Karr | 52/2 |
| 5,065,640 | 11/1991 | Koren et al. | 52/2.21 X |
| 5,295,302 | 10/1981 | Liu | 52/2.21 |
| 5,421,128 | 6/1995 | Sharpless et al. | 52/2.13 |

FOREIGN PATENT DOCUMENTS

| | | | |
|---|---|---|---|
| 1379026 | 10/1964 | France | 52/2.13 |
| 4019429 | 1/1992 | Germany | 52/2.13 |

*Primary Examiner*—Lanna Mai

*Attorney, Agent, or Firm*—Richard L. Miller, P.E.

[57] ABSTRACT

The invention is an inflatable tube system, having an inflatable tube in the shape of a cylinder having two ends and a shaft. The tube includes a bladder, made of an elastometer in the shape of a cylinder, and a fabric covering made of woven polyethylene, the fabric covering enclosing the bladder. A pair of end closures sealing the fabric covering at the ends of the cylinder. An air valve extends into the bladder through one of the end closures.

5 Claims, 1 Drawing Sheet

FIG. 1
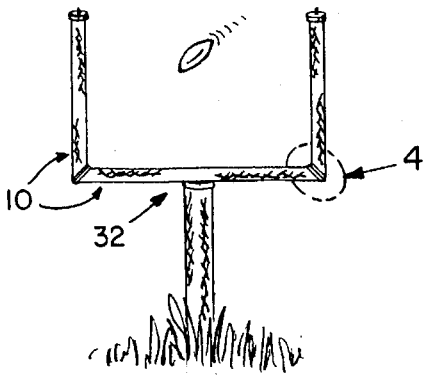
FIG. 2
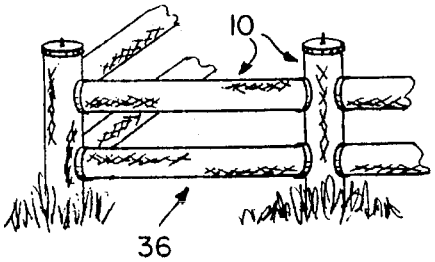
FIG. 3
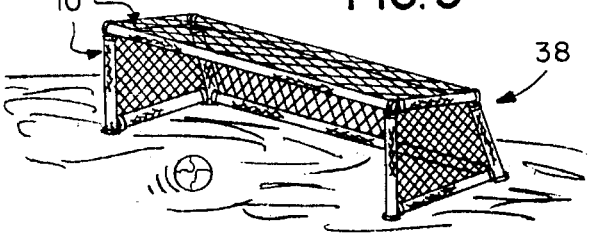
FIG. 4
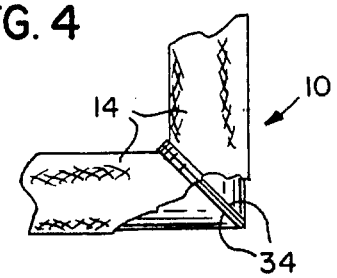
FIG. 5
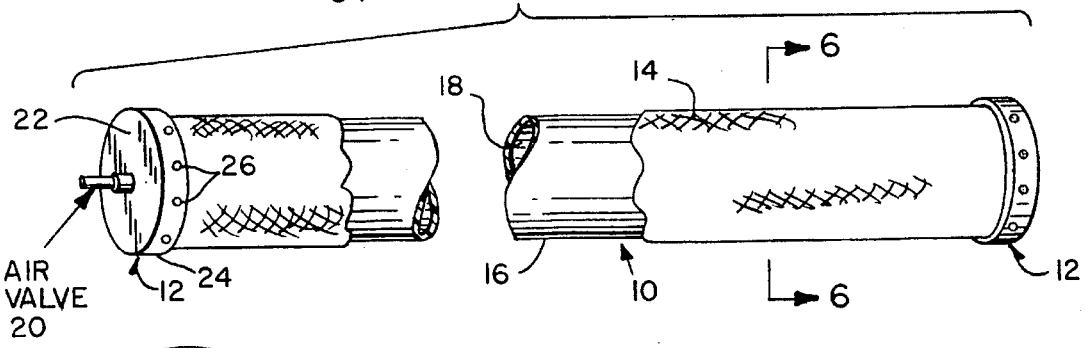
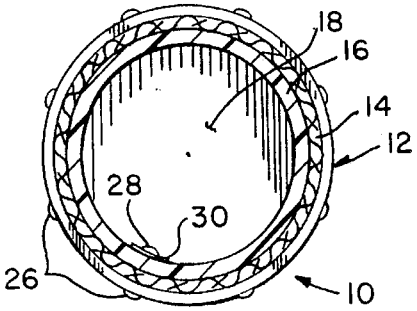
FIG. 6
FIG. 7
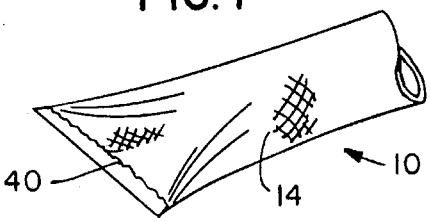

POLYETHELENE INFLATABLE TUBE CONSTRUCTION DEVICE

BACKGROUND OF THE INVENTION

The invention relates to a polyethylene inflatable tube system. More particularly, the invention relates to a tube that may be inflated with high pressure air, (typically in the range between 50 psi and 500 psi) and can then be used as a structural unit.

In certain applications, it is highly desirable to make structural units that are lightweight and have high strength characteristics.

Other inflatable devices are not reinforced, or are insufficiently reinforced to allow inflation to a high pressure. Since the internal pressure of these devices is relatively low when inflated, they are soft on the surface, making them unsuitable for use in any type of structure where strength is required.

U.S. Pat. No. 3,928,879 to Britschina et al. discloses an oval cross-section inflatable tube body that is designed for use in the construction of inflatable boats, bathing platforms, and the like.

U.S. Pat. No. 4,197,681 to Holcombe discloses an inflatable frame for a tent. The frame is designed to withstand low-pressure manual inflation.

U.S. Pat. No. 4,271,642 to Karr, discloses a tent with an inflatable tube erector, that is inflatable using lung pressure.

U.S. Pat. No. Des. 324,554 to McKinney discloses an inflatable toy football goal post.

While these units may be suitable for the particular purpose employed, or for general use, they would not be as suitable for the purposes of the present invention as disclosed hereafter.

SUMMARY OF THE INVENTION

It is an object of the invention to produce a inflatable tube that can be used as a structural unit in a multi-unit structure.

It is another object of the invention to produce an inflatable tube that is covered with a fabric having high bursting strength, so that the tube may be inflated to a high pressure.

It is further object of the invention to produce an inflatable tube that is strong and lightweight upon inflation, durable, and is inexpensive to manufacture.

The invention is an inflatable tube system, comprising an inflatable tube in the shape of a cylinder having two ends and a shaft. The tube comprises a bladder, made of an elastometer in the shape of a cylinder, and a fabric covering made of woven polyethylene, the fabric covering enclosing the bladder. A pair of end closures which may be caps extend over the fabric covering at the ends of the cylinder. An air valve extends into the bladder through one of the end caps. Alternatively the end closure may be accomplished by just a seamed closed along a distal edge of the fabric tube.

To the accomplishment of the above and related objects the invention may be embodied in the form illustrated in the accompanying drawings. Attention is called to the fact, however, that the drawings are illustrative only. Variations are contemplated as being part of the invent ion, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view illustrating a football goal constructed utilizing the instant invention;

FIG. 2 is a diagrammatic perspective view illustrating a fence constructed utilizing the instant invention;

FIG. 3 is a diagrammatic perspective view illustrating a soccer goal constructed utilizing the instant invention;

FIG. 4 is an enlarged diagrammatic perspective view with parts broken away taken in the area of the oval curve indicated by arrow 4 in FIG. 1;

FIG. 5 is an enlarged diagrammatic perspective view of the instant invention with parts broken away illustrating the internal construction thereof;

FIG. 6 is an enlarged diagrammatic cross sectional view taken on line 6—6 of FIG. 5; and FIG. 7 is shows an alternative end closure which is just a simple seam.

DETAILED DESCRIPTION OF THE PREFERRED EMBODIMENTS

FIG. 5 illustrates an inflatable tube 10. The tube 10 is in the shape of a cylinder having two ends and a shaft between the two ends. The tube 10 has two end caps 12 at the ends of the cylinder. The tube is comprised of a fabric casing 14 in the shape of a cylinder, and a bladder 16 having an internal cavity 18, the bladder 16 is also in the shape of a cylinder. The bladder 16 is covered with the fabric casing 14. The end caps 12 cover the fabric casing 14 at the ends of the cylinder. An air valve 20 extends through one of the end caps 12, and is in fluid communication with the internal cavity 18 of the bladder 16.

The fabric casing 14 is made of woven polyethylene, which provides for superior strength. The bladder 16 is made of an elastometer, so that it may expand within the confines of the fabric casing 14.

The end caps 12 each have a face 22 which corresponds to the ends of the cylinder, and a lip 24 which extends perpendicularly from the face 22 and along the shaft of the cylinder. The end caps 12 are attached to the cylinder with rivets 26 spaced around the lip 24. The rivets 26 extends through the end caps 12, and through the fabric casing 14, and bladder 16, fastening them all together.

FIG. 6 is a cross sectional view taken along line 6—6 in FIG 5. The inflatable tube 10 has an overall round cross section. The rivets 26 extend through the end cap 12, fabric casing 16, and bladder 16 into the internal cavity 18. The rivet 26 is attached in the internal cavity 18 with a rivet head 28, which extends from the rivet 26. To prevent the rivet head 28 from pulling through the bladder 16, a washer 30 is placed between the rivet head 28 and the bladder 16.

The inflatable tube 10 is inflated by applying a pressurized air source to the air valve 20. Pressurized air travels through the air valve 20 into the internal cavity 18. As the pressure increases, the bladder 16 begins to exert pressure on the fabric casing 14. The fabric casing does not significantly deform upon this increase in pressure, and therefore exerts equal pressure back upon the bladder 16. Due to its inherent strength, the polyethylene fabric casing 14 will withstand an extremely high pressure, and therefore will allow the internal cavity 18 to reach a very high pressure. The bladder 16 will not break down, since it is not allowed to expand sufficiently, and thus will never surpass the elastic limit of the elastometer of which it is constructed.

The inflatable tube 10 is inflated to an extent necessary to make the inflatable tube 10 as hard as some solid structural members with a denier strength of about 1300. To achieve this strength, inflation pressure in the range between 50 psi and 500 psi are typical depending upon the diameter of the tube the strength of the fabric employed and the particular application for which the tube is intended to be used.

FIG. 1 illustrates a possible use of the inflatable tube 10. The several inflatable tubes 10 are used to form a goal post 32.

FIG. 4 illustrates an embodiment of the inflatable tube 10 with 45 degree end caps 34. The 45 degree end caps 34 are elliptical, and traverse the cylinder at a 45 degree angle. The 45 degree end caps 34 allow the inflatable tubes 10 to be easily joined at right angles, by adjoining the 45 degree end caps 34 of two adjacent inflatable tubes 10.

In adjoining the 45 degree end caps 34, the air valve 20 might get in the way if it extended through the 45 degree end caps 34. Thus, after inflation, the bladder might be sealed at the air valve 20, and the air valve removed to allow 45 degree end caps 34 from adjacent inflatable tubes to be abutted to one another, or in the alternative the inflation might be accomplished at another point on the tube typically as seen in FIG. 1.

FIG. 2 illustrates the inflatable tubes 10 used to construct a fence 36.

FIG. 3 illustrates the inflatable tubes 10 in use in creating a soccer goal 38.

FIG. 7 illustrates the inflatable tube having an alternative end closure structure which is just a seam 40.

In conclusion, an inflatable tube system has been presented which allows for the construction of a variety of items with durable, lightweight inflatable tubes which match the strength of conventional building materials.

What is claimed is:

1. An inflatable tube, comprising:

a) a cylindrically-shaped elastomer bladder having a pair of ends and containing an internal cavity, said pair of ends of said cylindrically-shaped elastomer bladder having a plurality of circumferencially disposed throughbores;

b) a cylindrically-shaped woven polyethylene fabric casing having a pair of ends, said pair of ends of said cylindrically-shaped woven polyethylene fabric casing having a plurality of circumferencially disposed throughbores, said cylindrically-shaped woven polyethylene fabric casing covering said cylindrically-shaped elastomer bladder with said plurality of circumferencially disposed throughbores of said pair of ends of said cylindrically-shaped woven polyethylene fabric casing aligning with said plurality of circumferencially disposed throughbores of said pair of ends of said cylindrically-shaped elastomer bladder, so that said cylindrically-shaped elastomer bladder can expand to a high pressure in the range of 50 psi and 500 psi within the confines of said cylindrically-shaped woven polyethylene fabric casing without breaking due to the inherent strength of said cylindrically-shaped woven polyethylene fabric casing;

c) a pair of end closures covering said pair of ends of said cylindrically-shaped woven polyethylene fabric casing, each of said pair of end closures having a face corresponding to an end of said pair of ends of said cylindrically-shaped woven polyethylene fabric casing and a lip extending perpendicularly from said face of each of said pair of end closures and along said cylindrically-shaped woven polyethylene fabric casing, said lip of each of said pair of end closures having a plurality of circumferencially disposed throughbores aligning with said plurality of circumferencially disposed throughbores of each of said pair of ends of said cylindrically-shaped woven polyethylene fabric casing and aligning with said plurality of circumferencially disposed throughbores of each of said pair of ends of said cylindrically-shaped elastomer bladder;

d) an air valve extending through said face of one of said pair of end closures and in to said internal cavity of said cylindrically-shaped elastomer bladder and being in fluid communication therewith;

e) a plurality of rivets having a plurality of rivet heads, said plurality of rivet heads of said plurality of rivets disposed in said internal cavity of said cylindrically-shaped elastomer bladder, said plurality of rivets passing through said plurality of circumferencially disposed throughbores of said lip of each of said pair of end closures, passing through said plurality of circumferencially disposed throughbores of said pair of ends of said cylindrically-shaped woven polyethylene fabric casing, and passing through said plurality of circumferencially disposed throughbores of said pair of ends of said cylindrically-shaped elastomer bladder, so that said pair of end closures, said cylindrically-shaped woven polyethylene fabric casing, and said cylindrically-shaped elastomer bladder are fastened together simultaneously; and f) a plurality of washers disposed between said plurality of rivet heads and said cylindrically-shaped elastomer bladder, so that said plurality of rivet heads are prevented from pulling through said cylindrically-shaped elastomer bladder.

2. The tube as defined in claim 1 wherein said inflatable tube has a longitudinal axis to which at least one of said pair of end closures is angled 45 degrees, so that when said at least one 45 degree angled end closure of said pair of end closures of one said inflatable tube is joined to said at least one 45 degree angled end closure of said pair of end closures of another said inflatable tube said one inflatable tube is perpendicular to said another inflatable tube.

3. An inflatable football goal post, comprising:

a) a lower vertically-oriented inflatable tube having an upper end;

b) inflating means for inflating said lower vertically-oriented inflatable tube;

c) a horizontally-oriented inflatable crossbar tube being perpendicular to said lower vertically-oriented inflatable tube, said horizontally-oriented inflatable crossbar tube having a midpoint disposed on said upper end of said lower vertically-oriented inflatable tube and a pair of 45 degree angle ends;

d) inflating means for inflating said horizontally-oriented inflatable crossbar tube;

e) a pair of upper vertically-oriented, parallel, and spaced-apart inflatable upright tubes, each of said pair of upper vertically-oriented, parallel, and spaced-apart inflatable upright tubes having a 45 degree angle end disposed on each of said pair of 45 degree angle ends of said horizontally-oriented inflatable crossbar tube, so that said pair of upper vertically-oriented inflatable upright tubes are perpendicular to said horizontally-oriented inflatable crossbar tube and parallel to said lower vertically-oriented inflatable tube; and f) inflating means for inflating said pair of upper vertically-oriented and spaced-apart inflatable upright tubes;

wherein said lower vertically-oriented inflatable tube, said horizontally-oriented inflatable crossbar tube, and each of said pair of upper vertically-oriented, parallel, and spaced-apart inflatable upright tubes including:

i) a cylindrically-shaped elastomer bladder having a pair of ends and containing an internal cavity, said pair of ends of said cylindrically-shaped elastomer bladder having a plurality of circumferencially disposed throughbores;

ii) a cylindrically-shaped woven polyethylene fabric casing having a pair of ends, said pair of ends of said cylindrically-shaped woven polyethylene fabric casing having a plurality of circumferencially disposed throughbores, said cylindrically-shaped woven polyethylene fabric casing covering said cylindrically-shaped elastomer bladder with said plurality of circumferencially disposed throughbores of said pair of ends of said cylindrically-shaped woven polyethylene fabric casing aligning with said plurality of circumferencially disposed throughbores of said pair of ends of said cylindrically-shaped elastomer bladder, so that said cylindrically-shaped elastomer bladder can expand to a high pressure in the range of 50 psi and 500 psi within the confines of said cylindrically-shaped woven polyethylene fabric casing without breaking due to the inherent strength of said cylindrically-shaped woven polyethylene fabric casing;

iii) a pair of end closures covering said pair of ends of said cylindrically-shaped woven polyethylene fabric casing, each of said pair of end closures having a face corresponding to an end of said pair of ends of said cylindrically-shaped woven polyethylene fabric casing and a lip extending perpendicularly from said face of each of said pair of end closures and along said cylindrically-shaped woven polyethylene fabric casing, said lip of each of said pair of end closures having a plurality of circumferencially disposed throughbores aligning with said plurality of circumferencially disposed throughbores of each of said pair of ends of said cylindrically-shaped woven polyethylene fabric casing and aligning with said plurality of circumferencially disposed throughbores of each of said pair of ends of said cylindrically-shaped elastomer bladder;

iv) a plurality of rivets having a plurality of rivet heads, said plurality of rivet heads of said plurality of rivets disposed in said internal cavity of said cylindrically-shaped elastomer bladder, said plurality of rivets passing through said plurality of circumferencially disposed throughbores of said lip of each of said pair of end closures, passing through said plurality of circumferencially disposed throughbores of said pair of ends of said cylindrically-shaped woven polyethylene fabric casing, and passing through said plurality of circumferencially disposed throughbores of said pair of ends of said cylindrically-shaped elastomer bladder, so that said pair of end closures, said cylindrically-shaped woven polyethylene fabric casing, and said cylindrically-shaped elastomer bladder are fastened together simultaneously; and v) a plurality of washers disposed between said plurality of rivet heads and said cylindrically-shaped elastomer bladder, so that said plurality of rivet heads are prevented from pulling through said cylindrically-shaped elastomer bladder.

4. An inflatable fence section, comprising:

a) a pair of vertically-oriented, parallel, and spaced-apart inflatable post tubes;

b) inflating means for inflating said pair of vertically-oriented and spaced-apart inflatable post tubes;

c) a pair of horizontally-oriented, parallel, and spaced-apart inflatable rail tubes being perpendicular to and connecting said pair of vertically-oriented, parallel, and spaced-apart post inflatable tubes; and d) inflating means for inflating said pair of horizontally-oriented, parallel, and spaced apart inflatable rail tubes;

wherein each of said pair of vertically-oriented, parallel, and spaced-apart inflatable post tubes and each of said pair of horizontally-oriented, parallel, and spaced-apart inflatable rail tubes including:

i) a cylindrically-shaped elastomer bladder having a pair of ends and containing an internal cavity, said pair of ends of said cylindrically-shaped elastomer bladder having a plurality of circumferencially disposed throughbores;

ii) a cylindrically-shaped woven polyethylene fabric casing having a pair of ends, said pair of ends of said cylindrically-shaped woven polyethylene fabric casing having a plurality of circumferencially disposed throughbores, said cylindrically-shaped woven polyethylene fabric casing covering said cylindrically-shaped elastomer bladder with said plurality of circumferencially disposed throughbores of said pair of ends of said cylindrically-shaped woven polyethylene fabric casing aligning with said plurality of circumferencially disposed throughbores of said pair of ends of said cylindrically-shaped elastomer bladder, so that said cylindrically-shaped elastomer bladder can expand to a high pressure in the range of 50 psi and 500 psi within the confines of said cylindrically-shaped woven polyethylene fabric casing without breaking due to the inherent strength of said cylindrically-shaped woven polyethylene fabric casing;

iii) a pair of end closures covering said pair of ends of said cylindrically-shaped woven polyethylene fabric casing, each of said pair of end closures having a face corresponding to an end of said pair of ends of said cylindrically-shaped woven polyethylene fabric casing and a lip extending perpendicularly from said face of each of said pair of end closures and along said cylindrically-shaped woven polyethylene fabric casing, said lip of each of said pair of end closures having a plurality of circumferencially disposed throughbores aligning with said plurality of circumferencially disposed throughbores of each of said pair of ends of said cylindrically-shaped woven polyethylene fabric casing and aligning with said plurality of circumferencially disposed throughbores of each of said pair of ends of said cylindrically-shaped elastomer bladder;

iv) a plurality of rivets having a plurality of rivet heads, said plurality of rivet heads of said plurality of rivets disposed in said internal cavity of said cylindrically-shaped elastomer bladder, said plurality of rivets passing through said plurality of circumferencially disposed throughbores of said lip of each of said pair of end closures, passing through said plurality of circumferencially disposed throughbores of said pair of ends of said cylindrically-shaped woven polyethylene fabric casing, and passing through said plurality of circumferencially disposed throughbores of said pair of ends of said cylindrically-shaped elastomer bladder, so that said pair of end closures, said cylindrically-shaped woven polyethylene fabric casing, and said cylindrically-shaped elastomer bladder are fastened together simultaneously; and v) a plurality of washers disposed between said plurality of rivet heads and said cylindrically-shaped elastomer bladder, so that said plurality of rivet heads are prevented from pulling through said cylindrically-shaped elastomer bladder.

5. An inflatable soccer goal, comprising:

a) a pair of long top horizontally-oriented, parallel, and spaced-apart inflatable tubes having ends;

b) inflating means for inflating said pair of long top horizontally-oriented, parallel, and spaced-apart inflatable tubes;

c) a pair of short top horizontally-oriented, parallel, and spaced-apart inflatable tubes connecting said ends of said pair of long top horizontally-oriented, parallel, and spaced-apart inflatable tubes so as to form a hollow top;

d) inflating means for inflating said pair of short top horizontally-oriented, parallel, and spaced-apart inflatable tubes;

e) netting covering said hollow top;

f) a pair of short front vertically-oriented, parallel, and spaced-apart inflatable tubes extending vertically-downwardly from said ends of a forwardmost of said pair of long top horizontally-oriented, parallel, and spaced-apart inflatable tubes and having lower ends;

g) inflating means for inflating said pair of short front vertically-oriented, parallel, and spaced-apart inflatable tubes;

h) a pair of short rear substantially vertically-oriented, parallel, and spaced-apart inflatable tubes extending vertically-downwardly and rearwardly from said ends of a rearwardmost of said pair of long top horizontally-oriented, parallel, and spaced-apart inflatable tubes and having lower ends;

i) inflating means for inflating said pair of short rear substantially vertically-oriented, parallel, and spaced-apart inflatable tubes;

j) a long lower rear horizontally-oriented inflatable tube connecting said lower ends of said pair of short rear substantially vertically-oriented, parallel, and spaced-apart inflatable tubes and together with said rearwardmost of said pair of long top horizontally-oriented, parallel, and spaced-apart inflatable tubes and together with said pair of short rear substantially vertically-oriented, parallel, and spaced-apart inflatable tubes form a hollow rear;

k) inflating means for inflating said long lower rear horizontally-oriented inflatable tube;

l) netting covering said hollow rear;

m) a pair of short lower side horizontally-oriented inflatable tubes connecting said lower ends of said pair of short rear substantially vertically-oriented, parallel, and spaced-apart inflatable tubes to said lower ends of said pair of short front vertically-oriented, parallel, and spaced-apart inflatable tubes and together with said pair of short top horizontally-oriented, parallel, and spaced-apart inflatable tubes and together with said pair of short rear substantially vertically-oriented, parallel, and spaced-apart inflatable tubes, and together with said pair of short front vertically-oriented, parallel, and spaced-apart inflatable tubes form a pair of hollow sides;

n) inflating means for inflating said pair of short lower side horizontally-oriented inflatable tubes; and o) netting covering said pair of hollow sides; wherein each of each of said pair of long top horizontally-oriented, parallel, and spaced-apart inflatable tubes, each of said pair of short top horizontally-oriented, parallel, and spaced-apart inflatable tubes, each of said pair of short front vertically-oriented, parallel, and spaced-apart inflatable tubes, each of said pair of short rear substantially vertically-oriented, parallel, and spaced-apart inflatable tubes, said long lower rear horizontally-oriented inflatable tube, and each of said pair of short lower side horizontally-oriented inflatable tubes including:

i) a cylindrically-shaped elastomer bladder having a pair of ends and containing an internal cavity, said pair of ends of said cylindrically-shaped elastomer bladder having a plurality of circumferencially disposed throughbores;

ii) a cylindrically-shaped woven polyethylene fabric casing having a pair of ends, said pair of ends of said cylindrically-shaped woven polyethylene fabric casing having a plurality of circumferencially disposed throughbores, said cylindrically-shaped woven polyethylene fabric casing covering said cylindrically-shaped elastomer bladder with said plurality of circumferencially disposed throughbores of said pair of ends of said cylindrically-shaped woven polyethylene fabric casing aligning with said plurality of circumferencially disposed throughbores of said pair of ends of said cylindrically-shaped elastomer bladder, so that said cylindrically-shaped elastomer bladder can expand to a high pressure in the range of 50 psi and 500 psi within the confines of said cylindrically-shaped woven polyethylene fabric casing without breaking due to the inherent strength of said cylindrically-shaped woven polyethylene fabric casing;

iii) a pair of end closures covering said pair of ends of said cylindrically-shaped woven polyethylene fabric casing, each of said pair of end closures having a face corresponding to an end of said pair of ends of said cylindrically-shaped woven polyethylene fabric casing and a lip extending perpendicularly from said face of each of said pair of end closures and along said cylindrically-shaped woven polyethylene fabric casing, said lip of each of said pair of end closures having a plurality of circumferencially disposed throughbores aligning with said plurality of circumferencially disposed throughbores of each of said pair of ends of said cylindrically-shaped woven polyethylene fabric casing and aligning with said plurality of circumferencially disposed throughbores of each of said pair of ends of said cylindrically-shaped elastomer bladder;

iv) a plurality of rivets having a plurality of rivet heads, said plurality of rivet heads of said plurality of rivets disposed in said internal cavity of said cylindrically-shaped elastomer bladder, said plurality of rivets passing through said plurality of circumferencially disposed throughbores of said lip of each of said pair of end closures, passing through said plurality of circumferencially disposed throughbores of said pair of ends of said cylindrically-shaped woven polyethylene fabric casing, and passing through said plurality of circumferencially disposed throughbores of said pair of ends of said cylindrically-shaped elastomer bladder, so that said pair of end closures, said cylindrically-shaped woven polyethylene fabric casing, and said cylindrically-shaped elastomer bladder are fastened together simultaneously; and v) a plurality of washers disposed between said plurality of rivet heads and said cylindrically-shaped elastomer bladder, so that said plurality of rivet heads are prevented from pulling through said cylindrically-shaped elastomer bladder.

* * * * *